United States Patent [19]

Najjar et al.

[11] Patent Number: 4,778,484

[45] Date of Patent: Oct. 18, 1988

[54] PARTIAL OXIDATION PROCESS WITH SECOND STAGE ADDITION OF IRON CONTAINING ADDITIVE

[75] Inventors: Mitri S. Najjar, Hopewell Junction; Robert M. Suggitt, Wappingers Falls, both of N.Y.

[73] Assignee: Texaco Inc., White Plains, N.Y.

[21] Appl. No.: 101,519

[22] Filed: Sep. 28, 1987

[51] Int. Cl.[4] ..... C10J 3/46

[52] U.S. Cl. ..... 48/197 R; 48/206; 48/215; 48/DIG. 2; 252/373

[58] Field of Search ..... 48/197 R, 206, 210, 48/211, 215, DIG. 2; 252/373

[56] References Cited

U.S. PATENT DOCUMENTS

| | | | |
|---|---|---|---|
| 3,784,364 | 1/1974 | Slater et al. | 48/215 |
| 4,289,502 | 9/1981 | Muenger et al. | 48/77 |
| 4,547,203 | 10/1985 | Jahnke | 48/206 |
| 4,655,792 | 4/1987 | Kessler et al. | 48/215 |
| 4,668,429 | 5/1987 | Najjar | 252/373 |
| 4,705,536 | 11/1987 | Becker et al. | 48/197 R |

*Primary Examiner*—Peter Kratz

*Attorney, Agent, or Firm*—Robert A. Kulason; James J. O'Loughlin; Albert Brent

[57] ABSTRACT

Synthesis gas, fuel gas, or reducing gas is produced by the noncatalytic partial oxidation of a sulfur-containing liquid hydrocarbonaceous fuel or a slurry of sulfur-containing solid carbonaceous fuel with a free-oxygen containing gas in the first free-flow reaction zone located in a refractory lined gas generator at an autogenous temperature in the range of about 1900° F. to 2900° F. and above the ash-fusion temperature of the slag formed in the reaction zone. About 85 to 99 weight percent of the carbon in the fuel feed to the reaction zone is converted into carbon oxides. At least a portion of the hot effluent gas stream from the reaction zone is passed through a free-flow second reaction zone $R_2$ in admixture with a second portion of sulfur-containing fuel and an iron-containing additive. In the second reaction zone the carbon in the second portion of fuel, unconverted fuel and particulate matter from $R_1$ react with $H_2O$ and/or $CO_2$ to produce supplemental $H_2$ and/or carbon oxides. Further, at least a portion of the sulfur-containing gases e.g. $H_2S$ and COS react with the iron-containing additive to produce particulate matter comprising iron oxysulfide. Further, a portion of this newly formed particulate matter and/or the iron-containing additive combine with molten slag and/or ash in the hot raw gas stream passing through the second gas cooler. The slag produced thereby has a reduced ash fusion temperature and a reduced viscosity. The remainder of the newly formed particulate matter comprising iron oxysulfide and particulate carbon are entrained in the effluent gas stream leaving the second reaction zone and are separated from the effluent gas stream and optionally recycled to the partial oxidation reaction zone in admixture with fresh fuel feed.

49 Claims, No Drawings

PARTIAL OXIDATION PROCESS WITH SECOND STAGE ADDITION OF IRON CONTAINING ADDITIVE

BACKGROUND OF THE INVENTION

This invention relates to the partial oxidation of sulfur-containing liquid hydrocarbonaceous fuel or a slurry of sulfur-containing solid carbonaceous fuel. More specifically it relates to the in-situ removal of sulfur-containing gases and slag from the raw effluent synthesis gas stream produced in a refractory lined free-flow gas generator.

As supplies of petroleum gradually diminish sulfur-containing heavy liquid hydrocarbonaceous fuel and/or sulfur-containing coal which is America's most abundant form of fossil fule will play an increasingly major role in providing for the nation's energy requirements. One ton of coal contains the same amount of energy as three to four barrels of crude oil. Accordingly, in the future it will become necessary to produce an increasing fraction of liquid and gaseous fuels from these sulfur-containing comparatively low cost fuels. The synthesis, reducing, and fuel gases produced from these sulfur-containing materials contain a comparatively high e.g. from about 0.1 to 2.0 mole % of $H_2S$ and COS. The desirability for removing, at high temperatures a major share of the sulfur present in synthesis gas, as generated in a Partial Oxidation Gasification Process, is widely recognized. In particular, removal of sulfur from syngas at high temperatures would improve combined cycle thermal efficiency by eliminating the need for costly cooling of product gases for low temperature acid gas wet scrubbing such as with Selexol or Rectisol. When the synthesis gas is burned as fuel in a gas turbine, it may be unnecessary to remove the last trace of sulfur. Energy savings such as possible through a high temperature desulfurization process can outweigh the need to get an extremely low sulfur content fuel gas. The gas produced by this invention may be used with or without further processing and/or purification as a gaseous fuel or as feedstock for the catalytic synthesis of liquid fuels.

Synthesis gas, fuel gas, and reducing gas may be produced from coal by well known gasification processes. For example, coassigned U.S. Pat. Nos. 3,544,291 and 4,289,502 respectively relate to a process for the partial oxidation of slurries of coal, and to an apparatus for producing cleaned and cooled synthesis gas by the partial oxidation of solid carbonaceous fuel.

The subject invention is an improvement in the art since it permits long time operation of the partial oxidation gas generator without shut-down due to accumulation of slag on metal surfaces in the cooling zone. Further, it is superior to the single-stage mode wherein an iron and calcium containing additive is mixed with the fuel feedstock to the gasifier, such as described in coassigned U.S. Pat. No. 4,668,429, since iron can accept more sulfur at the lower temperature in the second reaction zone of the subject invention. Two-stage down-flowing and up-flowing gasification processes are known in the art, including for example U.S. Pat. Nos. 2,801,158; 2,961,310; 3,988,123; 4,436,531; and 4,647,294. However, these processes do not provide for in-situ desulfurization of the product gas, not for the production of slag having a lower melting point.

SUMMARY OF THE INVENTION

This is an improved two-stage continuous process for the in-situ sedulfurization of a stream of synthesis gas, fuel gas or reducing gas. In the first stage, non-catalytic partial oxidation of a first portion of sulfur-containing heavy liquid hydrocarbonaceous fuel and/or sulfur-containing solid carbonaceous fuel with a free-oxygen containing gas takes place in a first reaction zone $R_1$. In the second stage, the following take place in a second reaction zone $R_2$: (i) devolatilizing a second portion of said sulfur-containing fuel; (ii) reaction of carbon from said second portion of sulfur-containing fuel and carbon from theunreacted portion of said first portion of sulfur-containing fuel with $H_2O$ and/or $CO_2$ in the presence of an iron-containing additive to produce with an increased reaction rate additional $H_2$ and carbon oxides, (iii) conversion of sulfur in said second portion of sulfur-containing fuel into sulfur-containing gases e.g. $H_2S$ and COS; and (iv) in-situ conversion of said sulfur-containing gases into iron oxysulfide. The temperature in $R_2$ is lower than that in $R_1$. Preferably, the temperature in $R_1$ is above the softening temperature of the ash in $R_1$. Simultaneously in the second stage, the iron oxysulfide reacts with slag to produce slag with a reduced melting point. This slag may be easily separated from the product gas for example by gravity. Further, carbon conversion is increased by the catalytic reactions between carbon and $H_2O$ and/or $C_2$ in the presence of an iron-containing additive that take place in the second reaction zone.

The sulfur-containing fuel feedstock is divided into two portions. About 50 to 100 wt. %, such as about 70 to 95 wt. % of the total amount of fuel feedstock is gasified in the first reaction zone; and, the remainder of the fuel feed is gasified in the second reaction zone along with the unreacted portion of the fuel feedstock from the first reaction zone.

A liquid or gaseous carrier is used to introduce the fuel into the first down-flowing or upflowing unobstructed refractory lined vartical cylindrical shaped reaction zone gas generator. An effluent gas stream is produced by the partial oxidation of the sulfur-containing heavy liquid hydrocarbonaceous fuel and/or sulfur-constaining solid carbonaceous fuel in the first reaction zone located in a free-flow gas generator at a temperature in the range of about 1900° F. to 2900° F. and above the ash-fusion temperature of the slag formed in the first reaction zone, and a pressure in the range of about 2 to 250 atmospheres. A temperature moderator such as $H_2O$ may be employed when the carrier for the fuel is a liquid hydrocarbon fuel.

The partial oxidation gas generator is operated so as to convert into carbon oxides from about 85 to 99 wt. % of the carbon in the fuel feed entering the first reaction zone. The hot effluent gas stream leaving the gas generator comprises $H_2$, CO, C $O_2$, $H_2S$, COS and at least one gaseous material from the group consisting of $H_2O$, $N_2$, $CH_4$, $NH_3$, and A. Further, entrained in the hot effluent gas stream leaving the first reaction zone is particulate carbon e.g. any remaining unconverted fuel and/or soot and the non-combustible inorganic ash portion of the fuel e.g. slag from the reacted portion of the liquid hydrocarbonaceous or solid carbonaceous fuel.

At least a portion e.g. about 20 to 100 volume % of the hot effluent gas stream leaving the first reaction zone of the gas generator, with or without removal of a portion of the entrained particulate matter and/or slag, is passed through an unobstructed vertical central passage of a second reaction zone comprising a down-flowing, or up-flowing unobstructed refractory lined vertical cylindrical shaped chamber in admixture with a second portion of fuel comprising sulfur-containing heavy liquid hydrocarbonaceous fuel and/or sulfur-containing solid carbonaceous fuel, and an iron-containing additive. No supplemental free-oxygen containing gas from an external source is introduced into the second reaction zone. The remainder of the hot effluent gas stream, if any, from the first reaction zone may be cooled in a quench tank. Suitable gasification equipment which provide the first and second reaction zones $R_1$and $R_2$ that are suitable for use in the subject process are shown and described in coassigned U.S. Pat. Nos. 4,248,604; 4,328,006; 4,647,294; and also in U.S. Pat. No. 2,961,310. These patents are incorporated herein by reference. The iron-containing additive may be introduced into the hot effluent gas stream at the entrance to and/or at one or more locations within the second reaction zone $R_2$. Sufficient iron-containing additive is introduced into the hot effluent gas stream so as to provide in the second reaction zone $R_2$ iron atoms in the amount of about 1.1 to 1.8 times the atoms of sulfur in the second reaction zone $R_2$ plus about 0.3 to 1.2 times the atoms of silicon in the ash in the second reaction zone $R_2$. Further, the mole ratio of $H_2O$ and/or $CO_2$ in the second reaction zone to the total amount of carbon in the second portion of fuel that is introduced into the second reaction zone plus the carbon in the unreacted fuel and particulate matter entrained in the hot raw effluent gas stream entering the second reaction zone $R_2$ is in the range of about 0.7 to 25.0, such as about 1.0 to 20.

The hot effluent gas stream enters the second reaction zone $R_2$ at a temperature in the range of about 1900° F. to 2850° F. and leaves at a temperature in the range of about 1000° F. to 1600° F., such as 1500° F. Cooling is effected by devolatilization of the fuel and evaporization of any liquid carrier, and by the endothermic reaction of carbon with $H_2O$ and/or $CO_2$. The average temperature in $R_2$ is less than that in $R_1$.

As the effluent gas stream passes through the unobstructed central passage of the second reaction zone, at least a portion i.e. about 50–100 weight percent and preferably all of the sulfur-containing gases in the effluent gas stream e.g. $H_2S$ and COS react with the iron-containing additive to produce particulate matter comprising iron oxysulfide. Substantially no new elemental iron is formed from iron-containing additive compounds. Further, a portion e.g. about 5 to 20 wt. % of this newly formed particulate matter and iron-containing additive combine with slag and/or ash in the hot raw gas stream passing through the second reaction zone $R_2$ to produce slag with a reduced ash softening temperature and viscosity, in comparison with the ash softening temperature and viscosity of the ash and slag produced without the addition of the iron-containing additive. Gravity separation of the slag from the effluent gas stream is thereby facilitated. The remainder of the iron oxysulfide leaves the second reaction zone entrained in the effluent gas stream. The particulate matter is separated from the effluent gas stream by conventional gas-solids separation means and recycled to the reaction zone of the partial oxidation gas generator in admixture with the fuel feed. Alternatively, this newly formed particulate matter may be roasted to produce iron oxide and sulfur-containing gas e.g. $SO_2$. The iron oxide may be recycled to the second reaction zone as a portion of the iron-containing additive, and/or introduced into the partial oxidation first reaction zone in admixture with the fuel feed to facilitate removal of the ash. The $SO_2$ may be recovered as a useful by-product. Advantageously, portions of the sensible heat in the stream of hot effluent gas from the partial oxidation reaction zone are recovered by direct heat exchange with the fuel materials and carriers flowing through the second reaction zone. Further, the desulfurized product gas is available for use at a higher temperature. Costly reheating is thereby avoided.

DESCRIPTION OF THE INVENTION

The present invention pertains to a continuous two-stage process for the production of a desulfurized stream of synthesis gas, fuel gas, or reducing gas from sulfur-containing heavy liquid hydrocarbonaceous fuel and/or sulfur-containing solid carbonaceous fuel in a liquid or gaseous carrier. The hot effluent gas stream is produced in a first partial oxidation reaction zone. Sulfur-containing gases are then removed from the effluent gas stream in-situ in a second reaction zone at a temperature which is lower than that in the first reaction zone.

A typical down-flowing partial oxidation synthesis gas generator for use in the first stage is shown in coassigned U.S. Pat. No. 2,818,326, which is incorporated herein by reference. The gas generator is a vertical cylindrical steel pressure vessel lined on the inside with a thermal refractory material to provide the first reaction zone $R_1$. The second reaction zone $R_2$ is located downstream from the first reaction zone $R_1$. $R_1$ and $R_2$ may be two down-flowing, two up-flowing, or one down-flowing and one-upflowing vertical cylindrical shaped coaxial chambers. In one embodiment, $R_1$ and $R_2$ are two chambers connected in series by means of a coaxial passage having a diameter which is smaller than one or both chambers. For example, down-flowing vertical serially connected chambers are illustrated in FIG. 1 of coassigned U.S. Pat. No. 4,547,203, which is incorporated herein by reference. For purposes of the subject invention chamber 4 of FIG. 1 may serve as $R_1$; and, chamber 50 may serve as $R_2$. Intervening chamber 23 and side transfer line 27 may or may not be used.

The apparatus shown and described in coassigned U.S. Pat. No. 4,328,006, which is incorporated herein by reference may be also used for carrying out the subject invention. As shown in FIG. 1 of said embodiment, the hot effluent gas from the first down-flowing reaction zone 2 e.g. $R_1$ passes down through passage 5 into first gas diversion and residue separation chamber 4. Particulate solids and slag in the effluent gas stream drop out of the gas stream by gravity and fall through central outlet 30 into slag chamber 6. Quench water 31 may be contained in the bottom of chamber 6, or it may be dry. About 0 to 20 vol. % of the hot effluent gas may be diverted through chamber 6 as bleed gas. The remainder of the hot effluent gas is passed through outlet 43 and refractory 45 lined transfer line into second gas diversion and residue separation chamber 46. Solid material and slag drop through outlet 49 into second slag chamber 53. The hot gas stream passes upwardly through chamber 46 into the bottom of cooling section 65 where noncontact indirect heat exchange takes place with water. The second reaction zone e.g. $R_2$ may be chamber 4 or 46. A gas-solids separation device, such as cyclones 100 and 100*a*, may be used to separate solid particulate matter from the gas stream.

In another embodiment suitable, up-flowing serially connected chambers 24 and 25 are shown and described in U.S. Pat. No. 2,961,310, which is incorporated herein by reference. Another up-flowing gasifier is shown in U.S. Pat. No. 3,963,457. In carrying out the subject invention, chamber 24 of U.S. Pat. No. 2,961,310 may be used as $R_1$, and chamber 25 may be used as $R_2$. In the down-flowing mode, a burner is located in the top of the gas generator along the central vertical axis for introducing the feed stream into the first reaction zone. A suitable annulus-type burner is shown in coassigned U.S. Pat. No. 2,928,460 which is incorporated herein by reference. A suitable annulus type burner may be used to introduce feedstreams of fuel, $H_2$and/or $CO_2$, and iron-containing additive into the second reaction zone by way of a passage in the side wall of the vessel. For side wall burner installations, see FIGS. 1 and 2 of coassigned U.S. Pat. No. 4,647,294, which is incorporated herein by reference.

In still another embodiment of the subject process reaction zones $R_1$ and $R_2$ are coaxial and horizontally oriented. This embodiment may be carried out by the apparatus shown in coassigned U.S. Pat. No. 3,784,364, which is incorporated herein by reference. In accordance with this embodiment, a liquid hydrocarbonaceous material, steam and/or $CO_2$, iron-containing additive, and the effluent gas stream from the first partial oxidation gas generator $R_1$ are passed through the second generator $R_2$ where desulfurization and reactions between carbon and steam and/or $CO_2$ take place in the manner previously described. The temperature in the first and second reaction zones, e.g., generators 11 and 23 are preferably below the sotfening temperature of the ash, e.g., about 10°-100° F. below in said reaction zones. Advantageously, by operating at a lower temperature and in the fly-ash mode, more sulfur may be retained in the fly-ash than that which can be retained in molten slag. Further, the amount of iron-containing additive is reduced since substantially no iron silicates are formed. However, in comparison with operating $R_1$ and $R_2$ in the slagging mode, carbon conversion is reduced and gas cleaning is more difficult by operating in the fly-ash mode.

The term sulfur-containing solid carbonaceous fuel includes coal, such as anthracite, bituminous, subbituminous; coke from coal; lignite; residue derived from coal liquefaction; oil shale; tar sands; petroleum coke; asphalt; pitch; particulate carbon (soot); concentrated sewer sludge; and mixtures thereof. The sulfur content of the solid carbonaceous fuel is in the range of about 0.2 to 8.0 wt. %. The ash or inorganic portion of the solid carbonaceous fuel is in the range of about 0.1 to 30 wt. %. Ash from solid carbonaceous fuel substantially comprises the oxides of Si, Fe, V, Ni and Al. The solid carbonaceous fuel may be ground to a particle size so that 100% passes through an ASTM E11-70 Sieve Designation Standard (SDS) 1.40 mm Alternative No. 14. Pumpable slurries of solid carbonaceous fuels may have a solids content in the range of about 25-70 wt. % such as 45-68 wt. %, depending on the characteristics of the fuel and the slurrying medium. The slurrying medium may be water, liquid hydrocarbon, or mixtures thereof.

The term sulfur-containing heavy liquid hydrocarbon fuel, as used herein, is intended to include various materials, such as virgin crude, residue from petroleum distillation and cracking, petroleum distillates, reduced crude, whole crude, asphalt, coal tar, coal derived oil, shale oil, tar sand oil and mixtures thereof. The sulfur and ash contents of the heavy liquid hydrocarbonaceous fuel are respectively in the ranges of about 0.5 to 5.0 weight %; and 100 to 10,000 parts per million. Ash from heavy liquid hydrocarbonaceous fuel substantially comprises the oxides and some sulfides of Fe, Ni, V, and Si.

The use of a temperature moderator to moderate the temperature in the first reaction zone of the gas generator and optionally in the second reaction zone depends in general on the carbon to hydrogen atomic ratio of the feedstock and the oxygen content of the oxidant stream. Suitable temperature moderators include steam, water, $C_2$-rich gas, liquid $CO_2$, recycle synthesis gas, a portion of the cooled clean exhaust gas from a gas turbine employed downstream in the process with or without admixture with air, by-product nitrogen from the air separation unit used to produce substantially pure oxygen, and mixtures of the aforesaid temperature moderators. Water serves as the carrier and the temperature moderator with slurries of water and solid carbonaceous fuel. However, steam may be the temperature moderator with slurries of liquid hydrocarbonaceous fuel and solid carbonaceous fuel. Generally, a temperature moderator is used with liquid hydrocarbon fuels and with substantially pure oxygen. The temperature moderator may be introduced into the gas generator in admixture with either the solid carbonaceous fuel feed, the free-oxygen containing gas stream, or both. Alternatively, the temperature moderator may be introduced into the first and/or second reaction zones by way of a separate conduit in the fuel burner. When $H_2O$ is introduced into the first and/or second reaction zones either as a temperature moderator, a slurrying medium, or both, the weight ratio of water to the carbon in the solid carbonaceous fuel plus liquid hydrocarbon fuel if any, is in the range of about 0.3 to 2.0 and preferably in the range of about 0.5 to 1.0.

The term free-oxygen containing gas, as used herein in the first reaction zone is intended to include air, oxygen-enriched air, i.e. greater than 21 mole % oxygen, and substantially pure oxygen, i.e., greater than 95 mole % oxygen, (the remainder comprising $N_2$ and rare gases). Free-oxygen containing gas may be introduced into the burner at a temperature in the range of about ambient to 1200° F. The atomic ratio of free-oxygen in the oxidant to carbon in the feed stock (O/C atom/atom) is preferably in the range of about 0.7 to 1.5, such as about 0.80 to 1.2. Substantially no supplementary free-oxygen is introduced into the second reaction zone other than that in the raw effluent gas stream from the first reaction zone.

The relative proportions of solid carbonaceous fuel, liquid hydrocarbon fuel if any, water or other temperature moderator, and oxygen in the feed streams to the first reaction zone in the gas generator, are carefully regulated to convert a substantial portion of the carbon in the fuel feed to the partial oxidation gas generator e.g. 85 to 99 wt. %, such as 80 to 95 wt. % of the carbon to carbon oxides e.g. CO and $CO_2$ and to maintain an autogeneous reaction zone temperature in the first reaction zone to a temperature in the range of about 1900° F. to 2900° F. and above the ash-fusion temperature of the slag formed in the reaction zone. The ash in the solid carbonaceous fuel may form fly-ash, molten slag, or mixtures thereof depending upon the actual temperature in the reaction zone. Molten slag is much easier to separate from the hot effluent gas than fly-ash. The pressure in the first and second reaction zones is in the range of about 2 to 250 atmospheres. The pressure in the second reaction zone is substantially the same as that in the first reaction zone less ordinary pressure drop in the lines. The dwell time in the first reaction zone of the partial oxidation gas generator in seconds is in the range of about 0.5 to 10, such as about 1.0 to 5. The dwell time in the second reaction zone in seconds is in the range of about 5 to 50, such as about 15 to 40 seconds.

The effluent gas stream leaving the first reaction zone in the partial oxidation gas generator has the following composition in mole % depending on the amount and composition of the feedstreams: $H_2$ 8.0 to 60.0, CO 8.0 to 70.0, $CO_2$ 1.0 to 50.0, $H_2O$ 2.0 to 50.0, $CH_4$ 0.0 to 2.0, $H_2S$ plus COS 0.10 to 2.0, $N_2$ 0.0 to 80.0, and A 0.0 to 2.0. Trace amounts of the following gaseous impurities may be also present in the effluent gas stream in parts per million (ppm): HCN 0 to 100; such as about 2 to 20; HCl 0 to about 20,000, such as about 200 to 2,000; and $NH_3$ 0 to about 10,000 such as about 100 to 1000. Entrained in the effluent gas stream is about 0.5 to 20 Wt. %, such as 1 to 4 wt. % particulate carbon (basis weight of carbon in the feed to the gas generator) comprising the remaining portion of the unconverted ash-containing solid carbonaceous fuel feed and/or soot. Molten slag resulting from the fusion of the ash content in the fuel or fly-ash is also entrained in the gas stream leaving the generator.

The iron-containing additive may be introduced into the hot effluent gas stream at the entrance to and/or at one or more locations within the second reaction zone. Sufficient iron-containing additive is introduced into the hot effluent gas stream so as to provide in the second reaction zone $R_2$ iron atoms in the amount of about 1.1 to 1.8 times the atoms of sulfur in the second reaction zone $R_2$ plus about 0.3 to 1.2 times the atoms of silicon in the ash in the second reaction zone $R_2$. Further, the mole ratio of $H_2O$ and/or $C_2$ in the second reaction zone to the total amount of carbon in the second portion of fuel introduced into the second reaction zone plus the carbon in the unreacted fuel and particulate matter entrained in the hot raw effluent gas stream entering the second reaction zone $R_2$ is in the range of about 0.7 to 25, such as about 1.0 to 20. The hot effluent gas stream from the gas generator may be passed in a downward or upward direction through the second reaction zone.

The iron-containing additive having a particle size (microns) in the range of about 1.0 to 1000, such as about 5.0 to 100, may be sprayed into the effluent gas stream at the entrance to or within the second reaction zone $R_2$ by means of spray nozzles, aspirators or atomizers. Any suitable number and arrangement of spray nozzles, aspirators, atomizers, or other suitable mixing means may be employed which allow the iron-containing material to intimately contact and mix with the hot effluent gas stream. For example, at least one spray nozzle may be located within the second reaction zone $R_2$ at the entrance so that the entering hot effluent gas stream may be immediately contacted by an atomized spray of iron-containing additive. At least one spray nozzle for spraying iron-containing material may be longitudinally spaced at various levels at and/or beyond the entrance of the second reaction zone $R_2$ e.g. along the central axis.

In one embodiment, an aqueous slurry comprising a second portion of sulfur-containing solid carbonaceous fuel in admixture with iron-containing additive material and having a solids content in weight % in the range of about 30 to 90, such as about 60 to 80, and at a temperature in the range of about ambient to 200° F. is mixed in the second reaction zone $R_2$with the hot effluent gas stream from the first reaction zone located in the partial oxidation gas generator. The rate of introduction and concentration of the slurry are such that after the water carrier is vaporized, the iron-containing additive that becomes intimately associated with the sulfur-containing gases and any molten slag and/or ash particles in the effluent gas passing through the second reaction zone $R_2$provides iron atoms in the amount of about 1.1 to 1.8 times the atoms of sulfur in the second reaction zone $R_2$ plus about 0.3 to 1.2 times the atoms of silicon in the ash in the second reaction zone $R_2$. In another embodiment, the iron-containing additive is entrained in a gaseous medium selected from the group consisting of steam, air, $CO_2$, $N_2$, recycle synthesis gas, and mixtures thereof. A suitable apparatus for carrying out this mode is illustrated in FIG. 1 of coassigned U.S. Pat. No. 4,248,604, which is incorporated herein by reference. In this embodiment, partial oxidation of a first portion of a slurry of sulfur-containing coal or other carbonaceous solid fuel e.g. petroleum coke takes place in the first reaction zone $R_1$—e.g. reference No. 16. A first portion of the hot raw effluent gas stream is mixed in the second reaction zone $R_2$—e.g. refractory lined antichamber 51 with a gas-solid mixture that is introduced into antichamber 51 via line 63 and comprising particles of a second portion of sulfur-containing coal or other sulfur-containing liquid hydrocarbonaceous or solid carbonaceous fuel in admixture with an iron-containing additive which is entrained in a cooled and cleaned stream of recycle product gas. The following reactions take place in the second reaction zone $R_2$: (i) devolatilizing of the second portion of said sulfur-containing fuel; (ii) reaction of carbon from said second portion of sulfur-containing fuel and carbon from any unreacted portion of said first portion of sulfur-containing fuel with $H_2O$ and/or $CO_2$ in the presence of an iron-containing additive to produce with an increased reaction rate additional $H_2$ and carbon oxides; (iii) conversion of sulfur in said second portion of sulfur-containing fuel into sulfur containing gases e.g. $H_2$ S and COS; and (iv) desulfurization by the reaction between the sulfur containing gases and the iron-containing additive to produce particles of iron oxysulfide. The entrained particulate matter, including iron oxysulfide and slag particles, is separated from the hot raw stream of synthesis gas by means of cyclone 56 and is passed out of antichamber 51 via bottom outlet 52. The material in line 59 may be ground and mixed with the sulfur-containing coal slurry fuel to gas generator 11, as an ash fusion temperature modifier. Alternatively, it may be roasted and processed to produce iron oxide which is recycled to antichamber 51. Further cooling and scrubbing of the raw stream of synthesis gas in line 64 may be accomplished in shell and tube gas coolers 65 and 66, and in gas scrubber 121. The cooled and cleaned synthesis gas leaves via line 159.

By the subject process, in the second reactio zone $R_2$, at least a portion e.g. 50 to 100 wt. %, such as about 70 to 95 wt. % of the sulfur originally present in the fuel feed and now in the form of sulfur-containing gases e.g. $H_2S$, COS react with the iron-containing additive to produce particulate matter comprising iron oxysulfide. Substantially no new elemental iron is formed in the second reaction zone from ironcontaining addition compounds. By definition, iron oxysulfide is iron sulfide in solution with iron oxide. The iron sulfide may be present in the solution in the range of about 10 to 99 wt.

%, and the remainder may comprise iron oxide. Further, the mole % $H_2S$ + COS in the effluent gas stream from the gas generator is reduced from a mole % of about 0.10 to 2.0 to less than about 0.05 mole % in the product gas by the subject process.

The iron-containing additive may comprise an inorganic or an organic iron compound. In one embodiment, the iron containing portion of said iron-containing additive is ferro or ferri organic compound selected from the group consisting of naphthenates, oxalates, acetates, citrates, benzoates, oleates, tartrates, and mixtures thereof. Preferably, the iron-containing additive is elemental iron or an iron compound selected from the group consisting of oxides, carbonates, nitrates, and mixtures thereof.

In another embodiment, the iron-containing additive is iron penta carbonyl, i.e. $Fe(CO)H_5$. Iron penta carbonyl, is a viscous yellow liquid with a boiling point of 102.8 ° C. It may be prepared by reacting iron or iron oxide with C or a CO-rich gas at a temperature of about 200° C. A portion of the CO-rich gas produced by the subject partial oxidation process and having a CO content of 30 volume % or more e.g. 50 to 70 volume % may be used in the preparation of iron penta carbonyl. Iron penta carbonyl in the liquid or vapor phase, may be easily mixed with the hot raw effluent gas stream from the partial oxidation reaction zone. Advantageously, there are no grinding costs when this iron-containing additive is used in the subject process.

In another embodiment, a metallic oxide from the group consisting of copper oxide, zinc oxide, calcium oxide and mixtures thereof is mixed with said iron-containing additive. For example from about 1 to 50 wt. 5, such as about 2 to 10 wt. %, of said metallic oxide (basis weight of said iron-containing additive) may be mixed with said iron-containing additive. The oxides of copper and/or zinc like the iron oxide, form sulfides. In addition, copper and zinc oxides catalyze the reactions between steam and carbon in the second reaction zone $R_2$ to produce supplemental $H_2$ and carbon oxide gases, and to complete the conversion of any unburned fuel or soot that may emanate from the partial oxidation unit.

In the preferred embodiment, the gas stream enters the second reaction zone $R_2$ at substantially the same temperature as that which it had when it left the first reaction zone $R_1$ of the partial oxidation gas generator i.e. about 1900 ° F. to 2900° F., less any ordinary drop in the lines i.e. about 50° F. to 100° F. temperature drop. Preferably,the temperature of the entering gas stream is above the ash-softening temperature of any ash that may be entrained in the gas stream. The gas stream leaves at the opposite end of the second reaction zone $R_2$ after its temperature has been reduced to a temperature in the range of about 1000° F.–2850° F., such as about 1350° F.–1800° F. The pressure of the gas stream in the second reaction zone $R_2$is substantially the same as that in the gas generator, less ordinary pressure drop in the lines i.e. about 1 atmosphere pressure drop. At these temperatures and pressures, sulfurcontaining gases e.g. $H_2S$ and COS that are produced in the partial oxidation reaction zone $R_1$ along with the effluent gas stream comprising $H_2$+CO react with the iron-containing additive to produce iron oxysulfide. From about 50 to 100 wt. %, such as about 70 to 95 wt. % of the iron oxysulfide leaves the second reaction zone $R_2$ in the form of discrete particles entrained in the effluent gas stream. A portion of the newly formed particles of iron oxysulfide e.g. about 0 to 10 wt. % and/or iron-containing additive combines with molten slag and/or ash in the hot raw gas stream passing through the second reaction zone $R_2$. The molten slag produced thereby has a reduced ash fusion temperature and a reduced viscosity in comparison with those values for the slag entering the second reaction zone $R_2$. Molten slag in the gas stream passing through the second reaction zone $R_2$ may be converted into solid particles when its temperature falls below the melting point of the slag. At least a portion e.g. about 10 to 100 wt. % of the molten and solid slag particles may be separated from the hot raw gas stream by gravity and may be collected in a separation vessel. The remainder of the slag, if any, may leave the second reaction zone $R_2$ entrained in the partially cooled gas stream. In one embodiment, the partially cooled gas stream leaving the second reaction zone $R_2$ is passed through a gas cooler e.g. radiant cooler. At least a portion of the molten and/or solid slag particles are discharged for example, from the lower end or entrance to the vertical radiant cooler and are collected in a catch pot or quench tank located at the bottom of the radiant cooler. See slag chamber 53 of coassigned U.S. Pat. No. 4,328,006, which is incorporated herein by reference. The remaining particles of iron oxysulfide leave the radiant cooler suspended in the cooled effluent gas stream. The particles of iron oxysulfide and particulate carbon e.g. uncoverted fuel particles and/or soot are separated from the effluent gas stream by conventional gas-solids separation means, and from about 0 to 100 wt. %, such as about 10 to 50 wt. %, may be recycled to the reaction zone of the partial oxidation gas generator in admixture with the fuel feed. In one embodiment, the particles of iron oxysulfide and carbon-containing material are separated from the cooled and desulfurized stream of synthesis gas leaving the radiant cooler by means of a cyclone separator or impingement separator of the types shown in coassigned U.S. Pat. Nos. 4,328,006 and 4,377,394, which are incorporated herein by reference. The remainder e.g. about 100 to 0 wt. % of this separated particulate matter comprising iron oxysulfide and particulate carbon may be roasted to produce iron oxide and sulfur-containing gas. The iron oxide and a substantially small amount of other particulate solids, if any, e.g. less than about 1.0 wt. % of ash are then separated from the sulfur-containing gases by conventional gas-solids separation means. The iron oxide may be recycled to the second reaction zone $R_2$ where it is introduced in admixture with make-up iron-containing additive and a second portion of the sulfur-containing liquid hydrocarbonaceous or solid carbonaceous fuel. Alternatively, a portion of the iron oxide may be recycled to the first reaction zone $R_1$ in the partial oxidation gas generator in admixture with said heavy liquid hydrocarbonaceous and/or solid carbonaceous fuel. In one embodiment, prior to roasting, the separated particulate matter is classified e.g. screened to remove material having a particle size greater than about 100 microns. This oversized material is rich in non-iron sulfide material e.g. silicates. In one embodiment, at least a portion e.g. 10 to 100 wt. % of said oversized material is mixed with the sulfur-containing heavy liquid hydrocarbonaceous fuel feed and/or the sulfur-containing solid carbonaceous fuel feed and introduced into the reaction zone of the partial oxidation gas generator as an ash-fusion temperature modifying agent.

Advantageously, in the subject process the catalytic reaction between carbon monoxide and steam may take place in the second reaction zone $R_2$ to produce additional hydrogen and carbon dioxide. In addition, carbon and steam may react in the second reaction zone $R_2$ to produce additional hydrogen and carbon oxides. The iron-containing additive material will catalyze these reactions.

Advantageously, useful thermal energy may be recovered from the hot effluent gas stream leaving the second reaction zone $R_2$ by passing it through a gas cooler. For example, by indirect heat exchange between the gas stream flowing through the central passageway of the radiant cooler and the cooling water flowing through the tube-wall, by-product steam may be produced.

The comparatively clean and partially cooled gas stream may leave the downstream end of the gas solids separation zone at a temperature below the maximum safe operating temperature for downstream devices used to recover energy from the hot gas stream such as a conventional convection type gas cooler, an expansion turbine for the production of mechanical or electrical energy, or both. The gas stream may be then passed through a downstream convection-type gas cooler or some other energy utilizing means where its temperature is reduced to a range of about 150° to 600° F. The gas stream may be then optionally subjected to additional process steps including gas scrubbing, methanation reactions, and purification, depending on its intended use as a synthesis gas, reducing gas, or fuel gas.

The advantages achieved by the subject process in which the iron-containing additive in admixture with a second portion of sulfur-containing liquid hydrocarbonceous and/or solid carbonaceous fuel is introduced directly into the second reaction zone include the following:

1. A $H_2+CO$ containing product gas is produced containing a reduced amount of sulfur-containing gases.

2. The gas stream passing through the second reaction zone $R_2$ is desulfurized while the temperature is maintained at a high level e.g. greater than 1000° F.

3. Supplemental $H_2$ and carbon oxide gases are produced at an increased reaction rate due to the catalytic reaction of carbon and steam in the presence of the iron-containing additive.

4. The sensible heat in the effluent gas stream from the partial oxidation gas generator may be efficiently used at high temperatures to provide the necessary energy to initiate and to carry out the desulfurization reaction.

5. The residence time in the partial oxidation gas generator may be reduced. This will result in shorter and less costly gas generators.

6. The thermal refractory lining of the gas generator is not subject to attack by contact with an iron-containing material.

7. Low grade solid fuels may be used as feed to the partial oxidation gas generator, without costly upgrading.

8. The iron-containing additive may be intimately mixed with the sulfur-containing gases in the hot gas stream in the second reaction zone $R_2$. When a liquid carrier is used and it vaporizes, nascent uncontaminated iron-containing material is released at an elevated temperature. In this active form, the iron-containing material is intimately mixed with and contacts the sulfur-containing gases and the molten slag. The conversion rate for the desulfurization and slagging reactions are thereby increased.

9. Separation of the molten slag entrained in the effluent gas stream passing through the second reaction zone $R_2$ may be facilitated. A portion of the iron-containing additive and/or newly formed iron oxysulfide will react with clay materials in the molten slag to form, for example, insoluble potassium ferro aluminosilicates. The melting point of the slag it thereby lowered and its fluidity is increased. In one embodiment, in the lower portion of an up-flowing vertical second reaction zone $R_2$ any fluxed molten slag easily separates from the gas stream and drops into a slag chamber located at the bottom of the second reaction zone. A pool of water may be contained in the bottom of the slag chamber, or it may be dry. In the second reaction zone, the temperature of the gas stream is reduced below the softening temperature of the ash in the fuel so that particulate iron oxysulfide may leave the second reaction zone $R_2$ entrained in the gas stream.

In another embodiment, simultaneously with the introduction of the iron-containing additive into the second reaction zone $R_2$, an ash fusion temperature modifying agent may be introduced into the first partial oxidation reaction zone $R_1$in admixture with the sulfur-containing liquid hydrocarbonaceous fuel and/or sulfur containing solid carbonaceous fuel. By this means, at least a portion of the molten slag e.g. about 10 to 75 wt. % may be removed from the hot raw effluent gas stream prior to the second reaction zone $R_2$. In such case, the weight ratio of ash fusion temperature modifying agent in the feed mixture to the gas generator to ash in the fuel feed is in the range of about 0.5 to 10, such as about 2 to 5. The ash-fusion temperature modifying agent may be a portion of the previously described iron-containing additive e.g. about 1 to 75 wt. %, such as 5 to 25 wt. % (basis total weight of iron-containing additive).

In still another embodiment, an alkali metal and/or alkali earth metal catalyst for the reaction between carbon and $H_2O$ or $C_2$ is introduced into the second reaction zone $R_2$ in admixture with the sulfur-containing liquid hydrocarbonaceous fuel and/or solid carbonaceous fuel and the iron-containing additive. The catalyst is present in the amount of about 5–50 wt. %, such as about 10–20 wt. % (basis wt. of entrained carbon). The mole ratio $H_2O$ and/or $C_2$ to carbon in the hot gas stream passing through the second reaction zone $R_2$ is in the range of about 0.7 to 25.0, or more, such as about 1.0 to 20, say about 1.5 to 6. Advantageously, unwanted HCN and HCl may be hydrolyzed in the presence of alkali metal and/or alkaline earth metal catalysts. The alkali metal and/or alkaline earth metal constituents are selected from the metals in the Periodic Table of Elements in Group IA and or IIA.

In one embodiment the sulfur-containing heavy liquid hydrocarbonaceous fuel and/or sulfur-containing solid carbonaceous fuel have ashes that include a minimum of 5.0 wt. % of vanadium, a minimum of 2.0 wt. % of nickel and silicon. Troublesome vanadium and nickel constituents in the ash of these fuels were removed in the slag by introducing into the first and second reaction zones $R_1$ and $R_2$ in admixture with fresh portions of the sulfur-containing fuel feedstock additive A comprising an iron-containing additive when the silicon content of said fuel feedstock is comparatively low, or additive B comprising an iron and calcium-containing additive when the silicon content of said fuel feedstock is comparatively high. For additional information with respect to additives A and B, reference is made to coassigned U.S. Pat. Nos. 4,668,428 and 4,668,429, which are incorporated herewith by reference.

Further, this embodiment pertains to a continuous process for the production of desulfurized synthesis gas, fuel gas, or reducing gas comprising: (1) mixing a first portion of sulfur-containing heavy liquid hydrocarbonaceous fuel and/or sulfur-containing solid carbonaceous fuel whose ashes include a minimum of 5.0 wt. % vanadium, a minimum of 2.0 wt. % of nickel, and silicon with additive A comprising an iron-containing additive when the silicon content of said fuel feedstock is less than about 350 ppm, or additive B comprising an iron and calcium-containing additive when the silicon content of said fuel feedstock is about 400 ppm or more; and reacting said mixture by partial oxidation with a free-oxygen containing gas and in the presence of a temperature moderator in a first free-flow refractory lined reaction zone of a gas generator at an autogeneous temperature in the range of about 1900° F. to 2900° F. and above the softening temperature of the ash in the first reaction zone, and a pressure in the range of about 2 to 250 atmospheres to produce a hot stream of synthesis gas, reducing gas, or fuel gas comprising $H_2$, CO, $C_2$, $H_2S$, COS and at least one gaseous material selected from the group consisting of $H_2O$, $N_2$, $CH_4$, $NH_3$, A, and containing entrained material comprising particulate carbon, unreacted fuel if any, and slag; wherein sufficient additive A or B is introduced into the first reaction zone so as to provide iron atoms when additive A is used or iron and calcium atoms when additive B is used in the amount of about 1.0 to 1.8 times the atoms of sulfur in the first reaction zone plus about 0.3 to 1.2 times the atoms of silicon in the ash in the first reaction zone;

(2) passing at least a portion of the hot gas stream from (1) in admixture with a second portion of said sulfur-containing heavy liquid hydrocarbonaceous fuel and/or sulfur-containing solid carbonaceous fuel and additive A comprising an iron-containing additive when the silicon content of said fuel feedstock is less than 350 ppm, or additive B comprising an iron and calcium-containing additive when the silicon content of said fuel feedstock is about 400 ppm or more through a second unobstructed free-flow refractory lined reaction zone; wherein sufficient additive A or B is introduced into the second reaction zone so as to provide iron atoms when additive A is used or iron and calcium atoms when additive B is used in the amount of about 1.0 to 1.8 times the atoms of sulfur in the second portion of sulfur-containing fuel plus the atoms of sulfur in the sulfur-containing gases in the second reaction zone plus about 0.3 to 1.2 times the atoms of silicon in the ash from said second portion of sulfur-containing fuel, and the mole ratio of $H_2O$ and/or $CO_2$ to carbon in the second reaction zone is in the range of about 0.7 to 25.0; and the weight ratio of additive A or B to ash in the first and second reaction zones is in the range of about 1.0–10.0 to 1.0, and for each part by weight of vanadium there is at least 10 parts by weight of iron when additive A is used, or at least 10 parts by weight of iron plus calcium when additive B is used;

(3) devolatilizing said second portion of sulfur-containing fuel in said second reacton zone; and reacting in said second reaction zone in the absence of additional free-oxygen containing gas and at a temperature in the range of about 1000° F.–2850° F., (i) $H_2O$ and/or $C_2$ with carbon from said second portion of fuel, particulate carbon, and unreacted fuel, if any to produce supplemental $H_2$ and carbon oxides, entrained molten slag, and (ii) said additive A or B with the sulfur containing gases in the gas streams produced in steps (1) and (2) to produce particulate matter comprising iron oxysulfide and also calcium sulfide with additive B; and where in said second reaction zone when additive A is used said iron-containing additive combines with at least a portion of said nickel constituents and sulfur from the feedstock to produce a liquid phase washing agent that collects and transports at least a portion of the vanadium-containing oxide laths and spinels and other ash components and refractory out of the second reaction zone; and when additive B is used separate portions of said iron-and calcium-containing additive (I) combine with a portion of said nickel, calcium and sulfur to generate a liquid phase washing agent that collects and transports a portion of the vanadium-containing oxide laths and spinels and other ash components and refractory; and (II) combine with a portion of said nickel, calcium and silicon to generate a liquid oxide-silicate phase that fluxes substantially all of the remaining portion of said vanadium-containing oxide laths and spinels and other ash components to produce molten slag; and (4) discharging from said second reaction zone a stream of synthesis gas, reducing gas, or fuel gas and slag; and in comparison with the product gas stream produced without the introduction of said additive A or B in (1) and (2), the gas stream discharged from (4) contains a reduced amount of sulfur-containing gases, and increased amounts of $H_2$+carbon oxides, iron oxysulfide and calcium sulfide particulate matter.

The iron containing additive A contains iron compounds selected from the group consisting of oxides, carbonates, carbonyl, nitrates and mixtures thereof. The iron and calcium-containing additive B contains iron and calcium compounds selected from the group consisting of oxides, carbonates, nitrates, and mixtures thereof.

The iron containing portion of said additive A and B is a ferro or ferri organic compound selected from the group consisting of naphthenates, oxalates, acetates, citrates, benzoates, oleates, tartrates, and mixtures thereof. For example the iron-containing portion of additive A or B is iron oxide; and in additive B said iron oxide is in admixture with calcium oxide. Included in the additive A or B may be an additional material compound selected from the group of elements consisting of magnesium, chromium and mixtures thereof in the total amount of about 1.0 to 10.0 wt. % of said iron-containing additive. Iron-containing additive A comprises about 30.0 to 100.0 wt. % of an iron compound. The iron and calcium-containing additive B comprises about 30.0 to 90.0 wt. % of an iron compound, preferably iron oxide, and the remainder may substantially comprise a calcium compound preferably calcium oxide. The sulfur-containing heavy liquid hydrocarbonaceous fuel having a nickel and vanadium-containing ash feedstock is selected from the group consisting or crude residue from petroleum distillate, reduced crude, whoel crude, asphalt, coal tar, coal derived oil, shale oil, tar sand oil, and mixtures thereof. In one embodiment, the sulfur-containing solid carbonaceous fuel having a nickel and vanadium-containing ash is petroleum coke. Substantially all of the sulfur in said feedstock is converted into the sulfides of iron and nickel with additive A and iron, nickel and calcium with additive B and leave the first and second reaction zones in the slag. The mixture of additive A or B and feedstock from (1) has a particle size of ASTM E-11 Standard Sieve Designation in the range of about 210 microns to 37 microns, or below. The previously described liquid phase washing agent substantially comprises in wt. %: iron sulfide about 75 to 95 , nickel sulfide about 0.5 to 3.0, and iron oxide about 2 to 9.

The first and second reaction zones may be two free-flow unobstructed vertical cylindrical shaped chambers with the products of reaction passing downwardly or upwardly through the first reaction zone and then downwardly or upwardly through the second reaction zone. For example the first and second reaction zones are two down-flowing coaxial refractory lined free-flow chambers located in the same pressure vessel. Alternatively, the first and second reaction zones are two up-flowing coaxial chambers located in the same pressure vessel. In one embodiment such as accomplished with the apparatus shown in coassigned U.S. Pat. No. 4,328,006 which is incorporated herein by reference, prior to the second reaction zone 4 or 46 at least a portion of the molten slag entrained in the hot effluent gas stream from the first reaction zone is separated from the hot gas stream.

Other modifications and variations of the invention as hereinbefore set forth may be made without departing from the spirit and scope thereof, and therefore only such limitations should be imposed on the invention as are indicated in the appended claims.

We claim:

1. A continuous process for the production of desulfurized synthesis gas, fuel gas, or reducing gas comprising:

(1) reacting a first portion of sulfur-containing heavy liquid hydrocarbonaceous fuel and/or sulfur-conatining solid carbonaceous fuel by partial oxidation with a free-oxygen containing gas and in the presence of a temperature moderator in a first free-flow refractory lined reaction zone of a gas generator at an autogenous temperature in the range of about 1900° F. to 2900° F. and a pressure in the range of about 2 to 250 atmospheres to produce a hot stream of synthesis gas, reducing gas, or fuel gas comprising $H_2$, C, $CO_2$, $H_2S$, COS and at least one gaseous material selected from the group consisting of $H_2O$, $N_2$, $CH_4$, $NH_3$, A, and containing entrained material comprising particulate carbon, unreacted fuel if any, and slag;

(2) passing at least a portion of the hot gas stream from 91) in admixture with a second portion of said fuel and an ironcontaining additive through a second unobstructed free-flow refractory lined reaction zone wherein sufficient iron-containing additive is introduced into the second reaction zone so as to provide iron atoms in the amount of about 1.1 to 1.8 times the atoms of sulfur in the second reaction zone plus about 0.3 to 1.2 times the atoms of silicon in the ash in the second reaction zone, and the mole ratio of $H_2O$ and/or $CO_2$ to carbon in the second reaction zone is in the range of about 0.7 to 25;

(3) devolatilizing said second portion of sulfur-containing fuel and reacting in said second reaction zone at a temperature below that in said first reaction zone and in the absence of additional free-oxygen containing gas, (i) $H_2O$ and/or $C_2$ with carbon from said second portion of fuel, particulate carbon and any unreacted portion of said first portion of fuel, to produce supplemental $H_2$ and carbon oxides, and (ii) said iron-containing additive with the sulfur containing gases in the gas streams produced in steps (1) and (2) to produce particulate matter comprising iron oxysulfide; and combining in said second reaction zone a portion of said newly formed particulate matter and/or iron-containing additive with slag and/or ash to produce slag having a reduced ash softening temperature and a reduced viscosity; and, (4) discharging from said second reaction zone a stream of synthesis gas, reducing gas, or fuel gas and slag; and in comparison with a gas stream produced without the introduction of said iron-containing additive in (2), the gas stream discharged from the second reaction zone contains a reduced amount of sulfur-containing gases, and increased amounts of $H_2$+carbon oxides and iron oxysulfide particulate matter.

2. The process of claim 1 wherein said iron-containing additive is introduced into the hot gas stream from (1) at the entrance to and/or at one or more locations within the second reaction zone.

3. The process of claim 1 wherein the temperature in the first reaction zone is above the softening temperature of the ash in the first reaction zone, and provided with the step of contacting the hot gas stream passing through said second reaction zone with an atomized spray of said iron-containing additive.

4. The process of claim 1 wherein the temperature in the first reaction zone is above the softening temperature of the ash in the first reaction zone, and provided with the step of separating at least a portion of the slag in (4) from said gas stream by gravity.

5. The process of claim 1 wherein the iron-containing additive in (2) comprises an inorganic or an organic iron compound.

6. The process of claim 1 wherein the iron containing portion of said iron-containing additive in (2) is a ferro or ferri organic compound selected from the group consisting of naphthenates, oxalates, acetates, citrates, benzoates, oleates, tartrates, and mixtures thereof.

7. The process of claim 1 wherein the iron-containing additive in (2) is elemental iron or an iron compound selected from the group consisting of oxides, carbonates, nitrates, and mixtures thereof.

8. The process of claim 1 wherein the iron-containing additive in (2) is $Fe(CO)_5$.

9. The process of claim 8 wherein said $Fe(CO)_5$ is prepared by reacting a portion of the CO-rich product gas with iron or iron oxide.

10. The process of claim 1 wherein the dwell times in the first and second reaction zones in (1) and (2) are respectively in the ranges of about 0.5–10 seconds and about 5 to 50 seconds.

11. The process of claim 1 wherein the hot stream of gas leaving the first reaction zone in (1) is introduced into the second reaction zone in (2) with substantially no change in temperature and pressure, except for ordinary losses of temperature and pressure in the lines.

12. The process of claim 1 wherein at least a portion of the entrained material and slag in the hot gas stream leaving the gas generator in (1) are removed respectively by gas-solids separation means and gravity prior to introducing the hot gas stream into the second reaction zone in (2).

13. The process of claim 1 wherein said sulfur-containing solid carbonaceous fuel is selected from the group consisting of coal, coke from coal; lignite; residue derived from coal liquefaction; oil shale; tar sands; petroleum coke; asphalt; pitch; particulate carbon (soot); and mixtures thereof.

14. The process of claim 1 wherein the iron-containing additive in(2) is introduced into said first reaction zone at one or more levels between the top and bottom of said reaction zone.

15. The process of claim 1 wherein said sulfur-containing liquid hydrocarbonaceous or solid carbonaceous fuel is introduced into said second reaction zone in (2) entrained in a liquid of gaseous carrier.

16. The process of claim 15 wherein said liquid carrier is selected from the group consisting of water, liquid hydrocarbonaceous fuel, and mixtures thereof.

17. The process of claim 15 wherein said gaseous carrier is selected from the group consisting of steam, air, $N_2$, $CO_2$, recycle synthesis gas, and mixtures thereof.

18. The process of claim 1 in which said temperature moderator is selected from the group consisting of steam, water, $CO_2$-rich gas, liquid $CO_2$, $N_2$, recycle synthesis gas, exhaust gas from a turbine, and mixtures thereof.

19. The process of claim 1 in which said free-oxygen containing gas is selected from the group consisting of air, oxygen-enriched air, i.e. greater than 21 mole % $O_2$, and substantially pure oxygen, i. e. greater than about 95 mole % $O_2$.

20. The process of claim 1 provided with the step of cooling the hot gas stream from (4) by indirect heat exchange thereby producing by-product steam.

21. The process of claim 20 provided with the step of separating iron oxysulfide and particulate carbon from the cooled effluent gas stream and recycling about 0 to 100 wt. % of said material to the reaction zone of the partial oxidation gas generator.

22. The process of claim 20 provided with the steps of separating particulate matter comprising iron oxysulfide and particulate carbon from the partially cooled gas stream in a gas-solids separation zone, roasting said particulate matter thereby substantially producing iron oxide and sulfur-containing gas, and separating said iron oxide from said sulfurcontaining gas.

23. The process of claim 22 provided with the step of introducing a portion of said iron oxide in admixture with make-up iron-containing additive entrained in a carrier into the second reaction zone in (2), where said materials are mixed with said hot gas stream from (1).

24. The process of claim 22 provided with the step of introducing a portion of said iron oxide into said partial oxidation reaction zone in (1) in admixture with said heavy liquid hydrocarbonaceous and/or solid carbonaceous fuel.

25. The process of claim 22 provided with the step of classifying said particulate matter prior to said roasting step and separating out materials having a particle size greater than about 100 microns.

26. The process of claim 25 provided with the step of mixing said materials having a particle size greater than about 100 microns with the sulfur-containing heavy liquid hydrocarbonaceous fuel feed and/or sulfur containing solid carbonaceous fuel feed in step (1), and introducing at least a portion of said mixture into the reaction zone of the partial oxidation gas generator.

27. The process of claim 1 wherein the hot gas stream from (1) is passed either in a downward or upward direction through first said and second reaction zones.

28. The process of claim 1 wherein said first and second reaction zones are coaxial and horizontally oriented, and the temperature in the first and second reaction zones are below the softening temperature of the ash in said reaction zones.

29. The process of claim 1 wherein the hot gas stream from (1) is contacted in said second reaction zone with at least one atomized spray of iron-containing additive at and/or beyond the entrance of said second reaction zone.

30. The process of claim 1 wherein a metallic oxide from the group consisting of copper oxide, zinc oxide, calcium oxide and mixtures thereof is introduced into the second reaction zone in (2) in admixture with said iron-containing additive and said second portion of fuel.

31. The process of claim 1 wherein an alkali metal and/or an alkaline earth metal compound is introduced into the second reaction zone in (2) in admixture with said iron-containing additive and said second portion of fuel.

32. The process of claim 31 wherein said alkali metal and/or alkaline earth metal constituents are selected from the metals in the Periodic Table of Elements in Groups IA and/or IIA.

33. A continuous process for the production of desulfurized synthesis gas, fuel gas, or reducing gas comprising:

(1) mixing a first portion of sulfur-containing heavy liquid hydrocarbonaceous fuel and/or sulfur-containing solid carbonaceous fuel whose ashes include a minimum of 5.0 wt. % vanadium, a minimum of 2.0 wt. % of nickel, and silicon with additive A comprising an iron-containing additive when the silicon content of said fuel feedstock is less than about 350 ppm, or additive B comprising an iron and calcium-containing additive when the silicon content of said fuel feedstock is about 400 ppm or more; and reacting said mixture by partial oxidation with a free-oxygen containing gas and in the presence of a temperature moderator in a first free-flow refractory lined reaction zone of a gas generator at an autogenous temperature in the range of about 1900° F. to 2900° F. and above the softening temperature of the ash in the first reaction zone, and a pressure in the range of about 2 to 250 atmospheres to produce a hot stream of synthesis gas, reducing gas, or fuel gas comprising $H_2$, CO, $CO_2$, HS, COS and at least one gaseous material selected from the group consisting of $H_2O$, $N_2$, $CH_4$, $NH_3$, A and containing entrained material comprising particulate carbon, unreacted fuel if any, and slag; wherein sufficient additive A or B is introduced into the first reaction zone so as to provide iron atoms when additive A is used or iron and calcium atoms when additive B is used in the amount of about 1.0 to 1.8 times the atoms of sulfur in the first reaction zone plus about 0.3 to 1.2 times the atoms of silicon in the ash in the first reaction zone;

(2) passing at least a portion of the hot gas stream from (1) in admixture with a second portion of said sulfur-containing heavy liquid hydrocarbonaceous fuel and/or sulfur-containing solid carbonaceous fuel and additive A comprising an iron-containing additive when the silicon content of said fuel feedstock is less than 350 ppm, or additive B comprising an ironand calcium-containing additive when the silicon content of said fuel feedstock is about 400 ppm or more through a second unobstructed free-flow refractory lined reaction zone; wherein sufficient additive A or B is introduced into the second reaction zone so as to provide iron atoms when additive A is used or iron and calcium atoms when additive B is used in the amount of about 1.0 to 1.8 times the atoms of sulfur in the second portion of sulfur-containing fuel plus the atoms of sulfur in the sulfur-containing gases in the second reaction zone plus about 0.3 to 1.2 times the atoms of silicon in the ash from said second portion of sulfur-containing fuel, and the mole ratio of $H_2O$ and/or $CO_2$ to carbon in the second reaction zone is in the range of about 0.7 to 25.0; and the weight ratio of additive A or B to ash in the first and second reaction zones is in the range of about 1.0–10.0 to 1.0, and for each part by weight of vanadium there is at least 10 parts by weight of iron when additive A is used, or at least 10 parts by weight of iron plus calcium when additive B is used;

(3) devolatilizing said second portion of sulfur-containing fuel in said second reaction zone; and reacting in said second reaction zone in the absence of additional free-oxygen containing gas and at a temperature in the range of about 1000° F.–2850° F., (i) $H_2O$ and/or COwith carbon from said second portion of fuel, particulate carbon and unreacted fuel, if any to produce supplemental $H_2$ and carbon oxides, entrained molten slag, and (ii) said additive A or B with the sulfur-containing gases in the gas streams produced in steps (1) and (2) to produce particulate matter comprising iron oxysulfide and also calcium sulfide with additive B; and where in said second reaction zone when additive A is used said iron-containing additive combines with at least a portion of said nickel constituents and sulfur from the feedstock to produce a liquid phase washing agent that collects and transports at least a portion of the vanadium-containing oxide laths and spinels and other ash components and refractory out of the second reaction zone; and when additive B is used separate portions of said iron and calcium-containing additive (I) combine with a portion of said nickel, calcium and sulfur to generate a liquid phase washing agent that collects and transports a portion of the vanadium-containing oxide laths and spinels and other ash components and refractory; and (II) combine with a portion of said nickel, calcium and silicon to generate a liquid oxide-silicate phase that fluxes substantially all of the remaining portion of said vanadium-containing oxide laths and spinels and other ash components to produce molten slag; and (4) discharging from said second reaction zone a stream of synthesis gas, reducing gas, or fuel gas and slag; and in comparison with the product gas stream produced without the introduction of said additive A or B in (1) and (2), the gas stream discharged from (4) contains a reduced amount of sulfur-containing gases, and increased amounts of $H_2$+carbon oxides and iron oxysulfide and calcium sulfide particulate matter.

34. The process of claim 33 wherein said iron-containing additive A contains iron compounds selected from the group consisting of oxides, carbonates, carbonyl, nitrates, and mixtures thereof.

35. The process of claim 33 wherein said iron and calcium-containing additive B contains iron and calcium compounds selected from the group consisting of oxides, carbonates, nitrates, and mixtures thereof.

36. The process of claim 33 wherein the iron-containing portion of said additive A or B is ferro or ferri organic compound selected from the group consisting of naphthenates, oxalates, acetates, citrates, benzoates, oleates, tartrates, and mixtures thereof.

37. The process of claim 33 wherein said iron and calcium-containing additive B comprises about 30.0 to 90.0 wt. % of an iron compound, and the remainder substantially comprises a calcium compound.

38. The process of claim 33 wherein said heavy liquid hydrocarbonaceous fuel having a nickel and vanadium-containing ash feedstock is selected from the group consisting of crude residue from petroleum distillation and cracking process operations, petroleum distrillate, reduced crude, whole crude, asphalt, coal tar, coal derived oil, shale oil, tar sand oil, and mixtures thereof.

39. The process of claim 33 wherein said sulfur-containing heavy liquid hydrocarbonaceous fuel and/or sulfur-containing solid carbonaceous fuel having a nickel and vanadium-containing ash is a pumpable slurry of petroleum coke in water, liquid in hydrocarbon fuel or mixtures thereof.

40. The process of claim 33 wherein said mixture of additive A or B and feedstock from (1) has a particle size of ASTM E-11 Standard Sieve Designation in the range of about 210 microns to 37 microns, or below.

41. The process of claim 33 wherein said iron-containing additive A comprises about 30.0 to 100.0 wt. % of an iron compound.

42. The process of claim 33 wherein a substantial portion of the sulfur in said feedstock is converted into sulfides of iron and nickel with additive A and iron, nickel and calcium with additive B and leave the first and second reaction zones in the slag.

43. The process of claim 33 wherein the iron-containing portion of additive A or B is iron oxide; and in additive B said iron oxide is in admixture with calcium oxide.

44. The process of claim 33 where included in the additive A or B in (1) is an additional material compound selected from the group of elements consisting of magnesium, chromium and mixtures thereof.

45. The process of claim 33 wherein said liquid phase washing agent substantially comprises in wt. %; iron sulfide about 75 to 95, nickel sulfide about 0.5 to 3.0, and iron oxide about 2 to 9.

46. The process of claim 33 wherein said first and second reaction zones are two free-flow unobstructed vertical cylindrical shaped chambers with the products of reaction passing downwardly or upwardly through the first reaction zone and then downwardly or upwardly through the second reaction zone.

47. The process of claim 46 wherein said first and second reaction zones are two down-flowing coaxial chambers located in the same pressure vessel.

48. The process of claim 46 wherein said first and second reaction zones are two up-flowing coaxial chambers located in the same pressure vessel.

49. The process of claim 33 wherein prior to the second reaction zone provided with the step of separating at least a portion of the slag entrained in the hot effluent gas stream from the first reaction zone.

* * * * *

UNITED STATES PATENT AND TRADEMARK OFFICE

CERTIFICATE OF CORRECTION

PATENT NO. : 4,778,484

DATED : October 18, 1988

INVENTOR(S) : M. S. Najjar and R. M. Suggitt

It is certified that error appears in the above—identified patent and that said Letters Patent is hereby corrected as shown below:

| | | | |
|---|---|---|---|
| Column 13 | line 65 | Change "$C_2$" to --$CO_2$-- |
| Column 15 | line 42 | Change "C" to --CO-- |
| Column 15 | line 48 | Change "91)" to --(1)-- |
| Column 15 | line 49 | Change "ironcontaining" to --iron containing-- |
| Column 15 | line 64 | Change "$C_2$" to --$CO_2$-- |
| Column 18 | line 46 | Change "HS" to --$H_2S$-- |
| Column 19 | line 24 | Change "COwith" to --$CO_2$ with-- |

UNITED STATES PATENT AND TRADEMARK OFFICE

CERTIFICATE OF CORRECTION

PATENT NO. : 4,778,484

DATED : October 18, 1988

INVENTOR(S) : M. S. Najjar and R.M. Suggitt

It is certified that error appears in the above—identified patent and that said Letters Patent is hereby corrected as shown below:

| | | | |
|---|---|---|---|
| Column 2 | line 29 | Change "$C_2$" to --$CO_2$-- |
| Column 6 | line 13 | Change "$C_2$" to --$CO_2$-- |
| Column 7 | line 37 | Change "$C_2$" to --$CO_2$-- |
| Column 8 | line 58 | Change "reactio" to --reaction-- |
| Column 12 | line 39 | Change "$C_2$" to --$CO_2$-- |
| Column 12 | line 45 | Change "$C_2$" to --$CO_2$-- |
| Column 13 | line 23 | Change "$C_2$" to --$CO_2$-- |

Signed and Sealed this

Sixteenth Day of May, 1989

*Attest:*

DONALD J. QUIGG

*Attesting Officer*

*Commissioner of Patents and Trademarks*